United States Patent [19]

Longinotti

[11] 4,234,634

[45] Nov. 18, 1980

[54] PREFABRICATION SYSTEM FOR BUILDING WALLS

[76] Inventor: Enrico Longinotti, Via Timoteo Bertelli 2, Florence, Italy

[21] Appl. No.: 935,951

[22] Filed: Aug. 23, 1978

[30] Foreign Application Priority Data

Aug. 23, 1977 [IT] Italy ..... 9555 A/77

[51] Int. Cl.[2] ..... B32B 3/30

[52] U.S. Cl. ..... 428/58; 428/71; 428/100; 428/119; 428/120; 428/159; 428/163; 428/166; 428/167; 428/178; 428/188; 428/322; 52/309.12

[58] Field of Search ..... 428/71, 52, 54, 58, 428/60, 163, 167, 178, 188, 99, 100, 158, 159, 166, 119, 120, 310, 322; 52/309.12

[56] References Cited

U.S. PATENT DOCUMENTS

| | | | |
|---|---|---|---|
| 2,376,653 | 5/1945 | Boyer | 428/71 |
| 3,043,730 | 7/1962 | Adie | 428/159 |
| 3,472,728 | 10/1969 | Hitch | 428/71 |
| 3,583,123 | 6/1971 | Holmgren et al. | 428/167 |
| 3,616,153 | 10/1971 | Downs | 428/188 |
| 3,653,170 | 4/1972 | Sheckler | 52/309.12 |
| 3,732,138 | 5/1973 | Almog | 428/188 |
| 4,044,520 | 8/1977 | Barrows | 52/309.12 |

FOREIGN PATENT DOCUMENTS

| | | | |
|---|---|---|---|
| 163515 | 7/1949 | Austria | 428/188 |
| 2208659 | 9/1973 | Fed. Rep. of Germany | 52/309.12 |
| 2256864 | 5/1974 | Fed. Rep. of Germany | 52/309.12 |
| 2324915 | 12/1974 | Fed. Rep. of Germany | 52/309.12 |
| 2422277 | 12/1975 | Fed. Rep. of Germany | 428/167 |

*Primary Examiner*—Stanley S. Silverman
*Attorney, Agent, or Firm*—McGlew and Tuttle

[57] ABSTRACT

A prefabricated construction for building walls, comprising a pair of panel elements each having a wall portion and a plurality of stiffening rib portions extending along the wall portion. At least some of the rib portions on each panel element include recesses on edges thereof which are spaced from the wall portions. The pair of panel elements face each other with substantial juxtaposition between the rib portions of one of the pairs of elements with those of the other of the pair of elements, and with the wall portions spaced from each other. The space between the wall portions and juxtaposed rib portions are substantially filled with expanded synthetic material to form a wall element and conduit passages are defined in the synthetic material between the pair of panel elements and adjacent the recesses in the rib portions.

13 Claims, 27 Drawing Figures

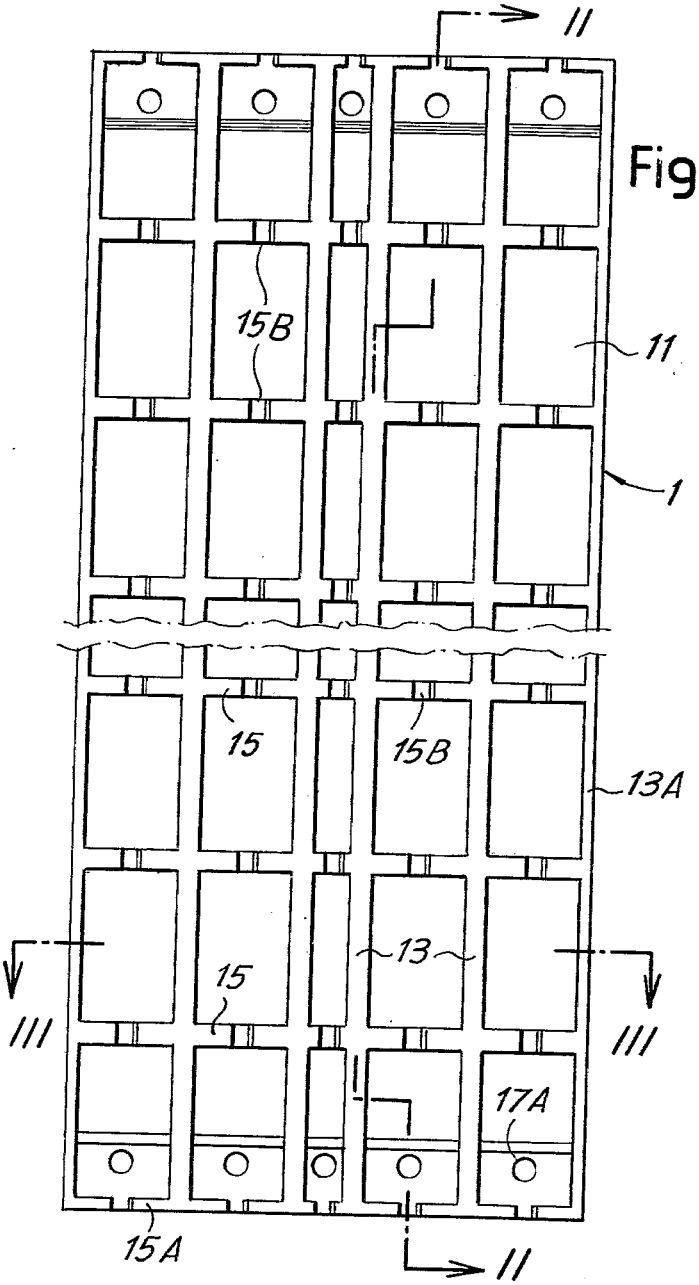
Fig.1
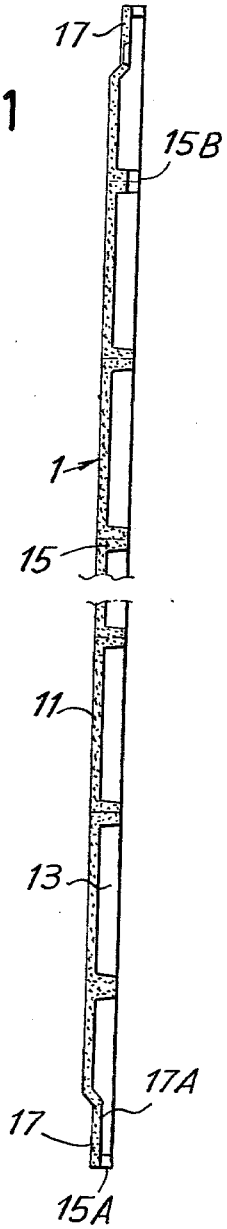
Fig.2
Fig.3
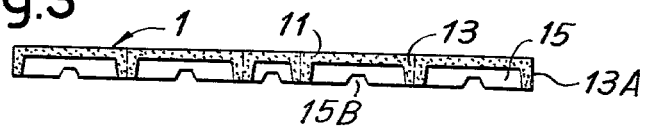

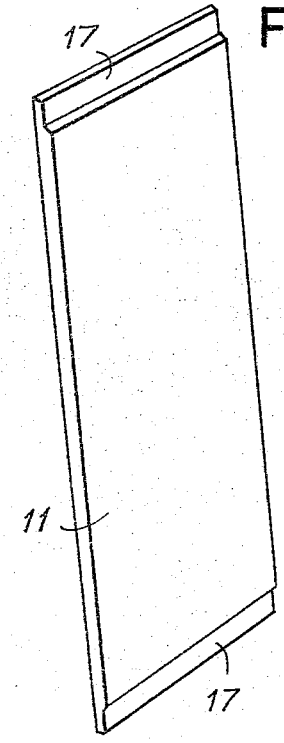
Fig.4
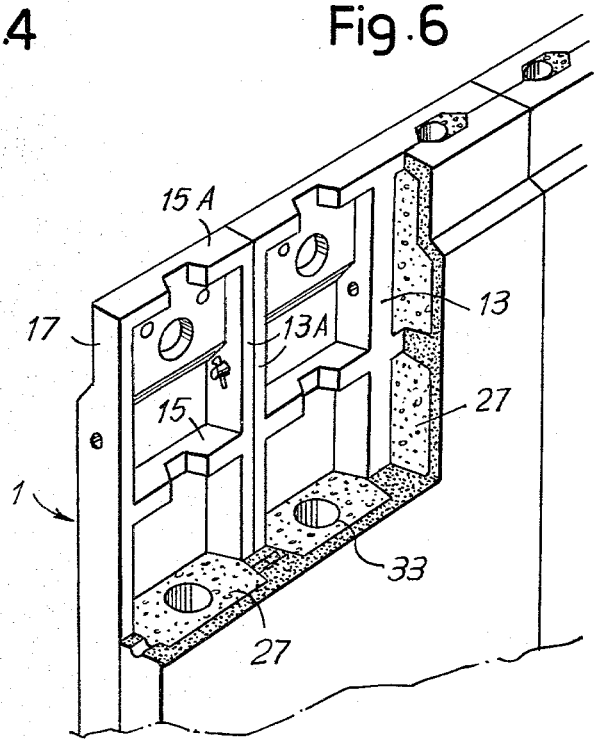
Fig.6
Fig.7
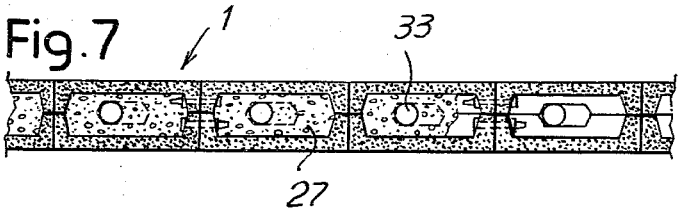
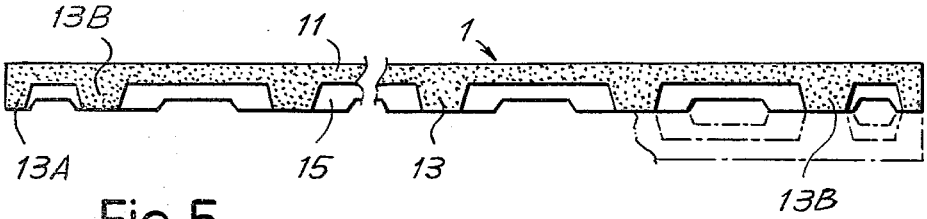
Fig.5

Fig. 16
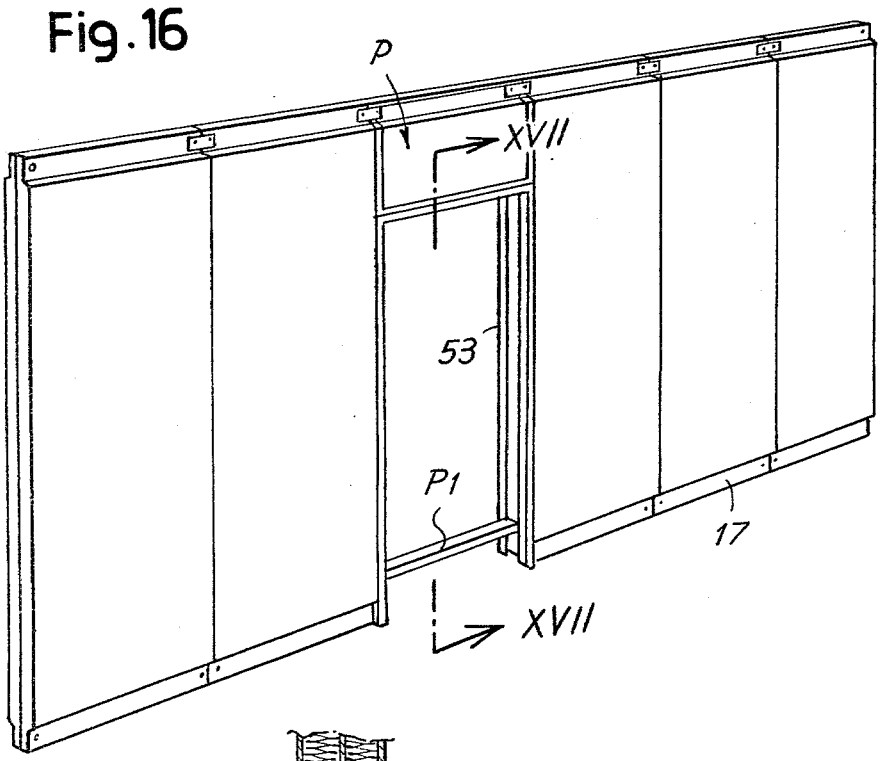
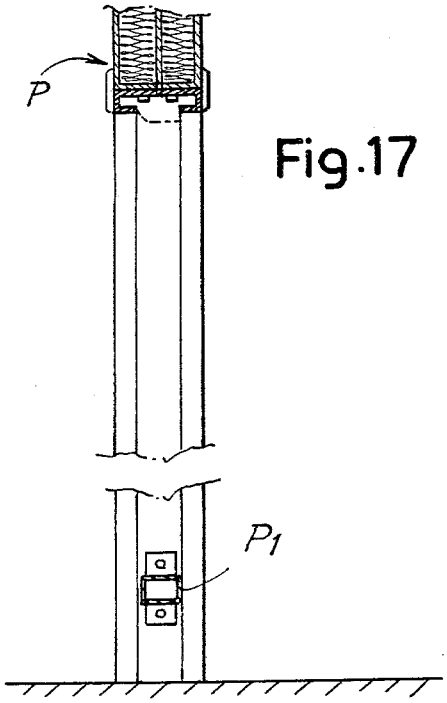
Fig. 17

Fig.18
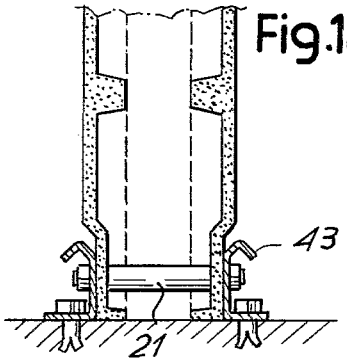
Fig.19
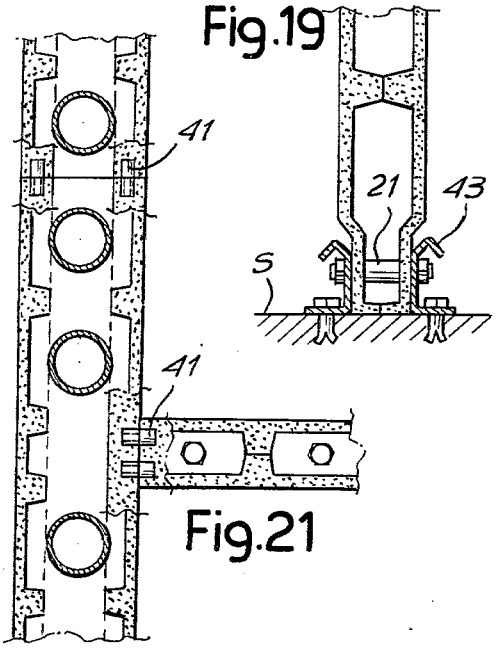
Fig.21
Fig.20
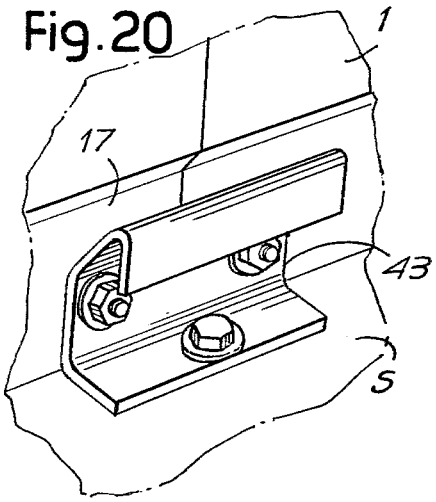
Fig.22
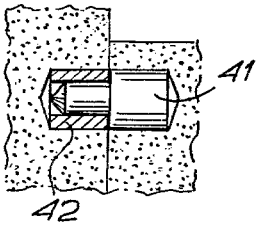
Fig.23
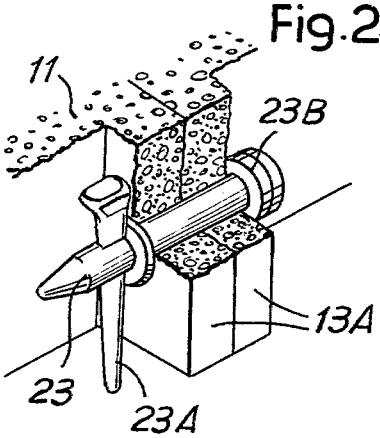
Fig.24
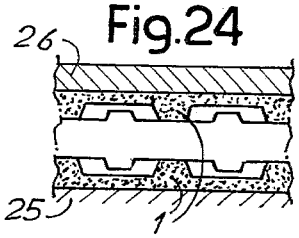
Fig.25
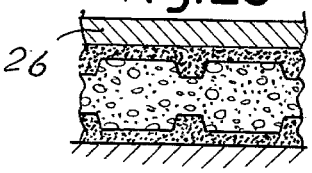

PREFABRICATION SYSTEM FOR BUILDING WALLS

FIELD AND BACKGROUND OF THE INVENTION

The present invention relates in general to a prefabrication system for forming closures and partition walls for buildings and the like and, in particular, to a new and useful prefabricated construction which inexpensively provides walls having favorable thermal and acoustic insulation and a porosity and hygroscopicity typical of conventional building structures.

SUMMARY OF THE INVENTION

In the prefabrication system for building walls, according to the invention, provision is made for pairs of shell-shaped or panel-shaped symmetrical elements, having stiffening ribs and lightening depressions or recesses on one face. The pairs of panel elements are made of cement or equivalent material and are preferably of the same shape. In a prefabrication, these elements are arranged facing each other with the ribbed surfaces facing one another. The space between the panel elements is filled with locally expanded synthetic material which steadily connects the two shell-shaped elements to form a wall element, and within which passages, such as conduits, are defined, for various services and uses.

The ribbed surfaces or rib portions of a pair of opposed panels may contact each other or can be spaced from each other with a corresponding thickness of locally expanded synthetic material therebetween. Spacing members may be provided between the two panel elements. A plurality of pairs of opposed panels can be assembled with mechanical connections therebetween and by a continuous mass of locally expanded synthetic material.

Each panel can be subdivided, in particular, by being sawed, to obtain wall structures of modular sizes. The shell-shaped or panel elements are each provided with recessed flat steps on their outside surfaces. The recessed steps extend along at least one of two edges which, in a building installation, are horizontal, and, in particular, along both edges. The recessed steps are designed to receive conduits and the like, such as lines, and electrical conductors. Provisions are made for transverse covering elements, such as skirting-boards, and frame-like elements to be placed on the panel elements at the building site to cover these lines and electrical conductors, as well as to cover connection means between the walls thus formed and horizontal floor structures or the like.

The reinforcement ribs extend in two orthogonal positions and include recesses to receive conduits or lines and the like formed within the mass of expanded resin. The flat surfaces of the panels or cement elements can be directly painted or coated with wallpaper or the like. They have the characteristics of traditional materials for building, while the walls are highly insulated due to the presence of the interior resin filling.

The panel can be designed to have a limited module, for example, of 100 mm, with the possibility of sawing a panel along its ribs, in order to be able to obtain a plurality of modular panels.

Accordingly, an object of the present invention is to provide a prefabricated construction for building walls, comprising, a pair of panel elements, each having a wall portion and a plurality of stiffening rib portions extending along said wall portion, at least some of said rib portions on each panel element including recesses on edges thereof spaced from said wall portions, said pair of panel elements facing each other with said rib portions of one of said pair of panel elements facing and juxtaposed with said rib portions with the other of said pair of panel elements, said wall portions being spaced from each other, and expanded synthetic material between said wall portions substantially filling the spaces between said wall portions and said rib portions with at least one conduit passage defined in said expanded synthetic material adjacent at least some of said recesses on said rib portion.

A further object of the invention is to provide a prefabricated construction for building walls which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

BRIEF DESCRIPTION OF THE DRAWINGS

In the Drawings:

FIG. 1 is a back elevational view of a single panel element made of pressed cement in accordance with the invention;

FIG. 2 is a view taken along lines II—II of FIG. 1;

FIG. 3 is a view taken along lines III—III of FIG. 1;

FIG. 4 is a front perspective view of the panel element shown in FIG. 1;

FIG. 5 is a top cross-sectional view of a panel element in accordance with the invention;

FIG. 6 is a front perspective view with portions cut away of a panel module made of two facing panel elements in accordance with the invention;

FIG. 7 is a top sectional view of the embodiment shown in FIG. 6;

FIG. 16 is a view, similar to FIG. 13, of a wall installation with a door opening;

FIG. 17 is a partial view, taken along lines XVII—XVII of FIG. 16;

FIGS. 18, 19, 20, 21, 22 and 23 are partial detailed views of various connecting means used in accordance with the invention;

FIG. 24 is a partial side sectional view of the panel elements in equipment to limit the width of the final panel module made therewith;

FIG. 25 is a view, similar to FIG. 24, with expanded synthetic material injected between the panel elements;

DESCRIPTION OF THE PREFERRED EMBODIMENTS

Figure 8:
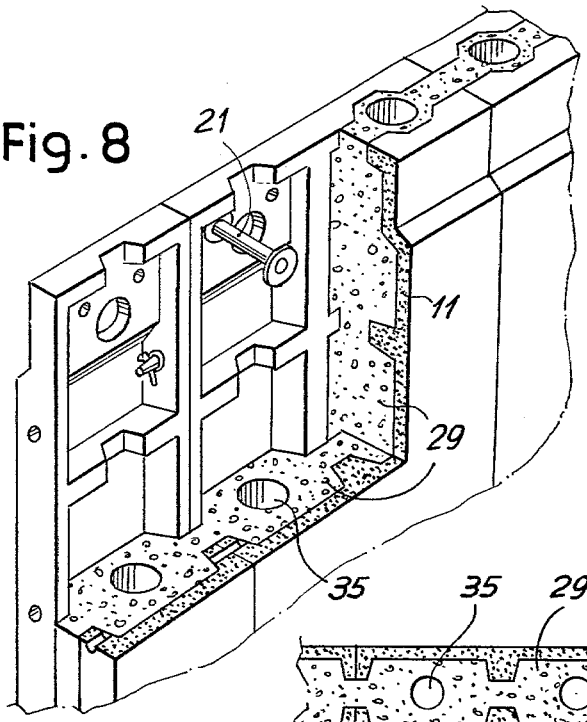
FIG. 8 is a view, similar to FIG. 6, of another embodiment of the panel module.

Referring to the drawings in particular, the invention embodied therein in FIGS. 1 through 4, comprises, panel elements, generally designated 1, having a wall portion 11 and a plurality of longitudinally and transversely extending stiffening ribs 13 and 15, respectively, extending therealong. Pairs of panel elements 1 are positioned facing each other with respective rib portions 13 and 15 facing each other and expanded synthetic material fills the space between the pair of panel elements to form a panel module (FIG. 6).

Panel elements 1 each include intermediate longitudinal ribs 13 and outer longitudinal ribs 13A which are thinner. Each panel element also includes transverse intermediate rigs 15 and transverse end ribs 15A. Ribs 15 include recesses 15B on their edges spaced from the wall portion 11. The outer surfaces of the wall 11 includes recessed steps 17 extending along the shorter sides of the panel element by a given height. These flat steps 17 are dado-like structures. The panel elements have a modular size with a height equal to the interspace between two horizontal structures of a building and with a suitably chosen width of, for example, 120 cm. The element can be cut longitudinally to obtain suitable submultiples, of for example, up to 10 cm.

FIG. 5 illustrates a solution to prove the possibility of obtaining transversal moudlar sizes of, for example, 100 mm in 100 mm. This can be obtained by sawing or otherwise cutting the panel elements in correspondence to the ribs 13 and 13B, which are closer to those 13A than between them and ribs 13 and 13B.

Figure 9:
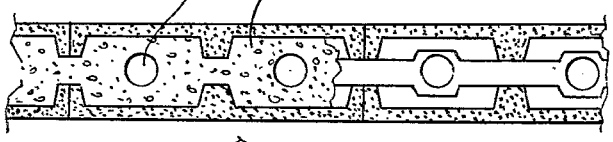
FIG. 9 is a top sectional view of the embodiment shown in FIG. 8.

The shells or panels 1 are used in pairs, facing each other with the face of each panel being provided with ribs 13 and 15 turned toward the other. Opposite surfaces of the substantially flat outer surfaces of wall portions 11 are directed toward the exterior and on either side of the panel module. The panels or shells can be placed in contact with ribs 13 and 15, as shown in FIGS. 6 and 7, or can be spaced from each other to a selected distance, as shown in FIGS. 8 and 9 and, respectively, 10 and 11. The spacing may be accomplished by the aid of spacers 21. A plurality of panel modules can by placed side-by-side, and the adjacent corresponding panels can be connected to each other with connecting means, such as pin means 23, with a wedge 23A and washers 23B in the synthetic resin or the like. See FIG. 23 in particular.

Interspaces are defined between the pairs or the series of pairs of panel elements, which are filled with spongy synthetic material of a type such as expanded polyurethane resins which are reacted in situ. The process provides for the localized expansion of the resins between the panels facing and kept spaced by the desired distance through spacers such as shown at 21 (FIGS. 8 and 10) or also by providing for jig equipment which is fit to allow a limitation of the relative movement between facing panel elements and also their straightening because of the thrust operated by the pressure due to the expansion of the synthetic resins during the expansion reaction.

FIGS. 24 and 25 show a lower fixed structure 25 forming a support and work surface and an overlying structure 26 spaced from the surface of the structure 25 by an amount corresponding to the final thickness desired for the wall unit or panel module to be obtained.

Pairs of elements 1 are placed, as shown in FIG. 24, in a suitably guided and contained manner, and then with a substantially traditional equipment, one proceeds to inject and to let react the reaction components of the foams, e.g., polyurethane foams in the spaces defined by elements 1 which originally rest on each other through the ribs 13 and 15.

The reaction and then the increase in volume of the foams being formed causes the movement of the upper shell elements 1 against the lower surface of the structure 26. The filling foam stabilizes under the conditions reached (FIG. 25). When a wall unit so formed is to include conduits, as better specified below, conduit cores which are removable or permanently installed in the wall, can be provided to form these conduits.

Figure 10:
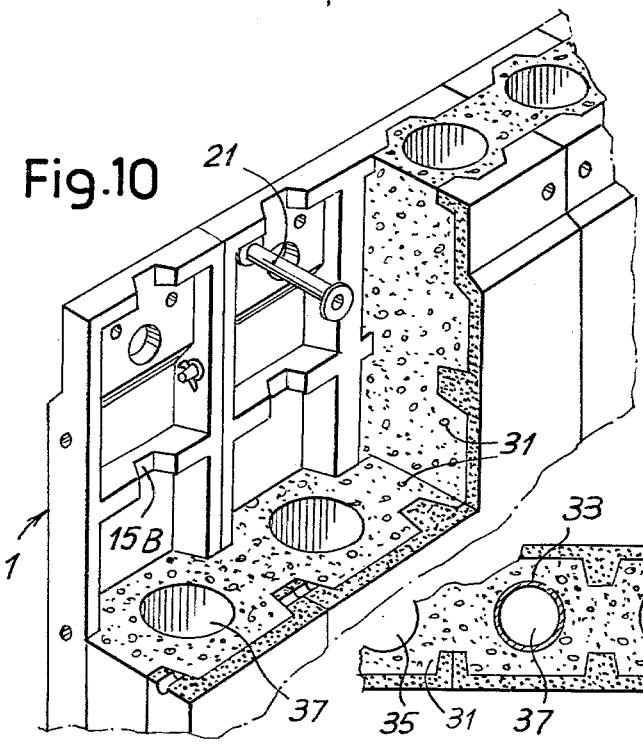
FIG. 10 is a view, similar to FIG. 8, of another embodiment of the panel module.
Figure 11:
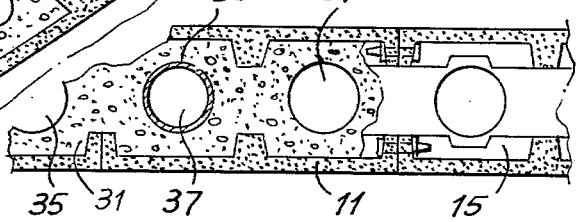
FIG. 11 is a top sectional view of the embodiment of FIG. 10.

Through the reaction of the components for the forming of synthetic resin foams, the spaces between facing shells or panels 1 are filled with foam as shown at 27 in FIGS. 6 and 7, respectively, 29, as shown in FIGS. 8 and 8, and 31, as shown in FIGS. 10 and 11, according to the final wall thickness desired and predetermined.

Through recoverable cores or unrecoverable tubular cores, shown at 33 in FIG. 11, in the expanded resins 27, 29 and 31, conduits 33, 35 and 27 are defined, which are substantially vertical and mostly correspond to, or are adjacent to the recesses 15B. Similar horizontal conduits can be provided in case they are needed with horizontal development in situ, by possibly (but not preferably) providing for indentations similar to those of 15B on the ribs 13 and 13A, as well. Compliance with the necessary strength as to both the depth of these indentations and their position must be met. Transversal conduits might cross the longitudinal ones 33 or 35 or 37 in this manner.

In the area of recessed steps 17 and at their intersection with the longitudinal conduits, such as 33, 35 and 37, depressions 17A are provided. Depressions 17A may be broken through to form openings for the passage of the internal conduits, where this is needed.

In the embodiment shown in FIGS. 8 and 11, the side-by-side connection between adjacent pairs of panel elements or panel modules can be provided by the expanded material 29 or 31 itself. This can be in place of, or in addition to, the connections formed by the pins shown in FIG. 23, or in another suitable manner. Also, the connection between the shells of the facing pairs can be carried out by the expanded material which can effectively adhere to the inner surfaces of wall 11 and of ribs 13 and 15, independently and also in the absence of the connecting bolts within the spacers, as shown in FIGS. 8, 10, 18 and 19.

With the process described, walls of a room can be built using a monolithic block for each wall of the same room or for a portion of a wall of a room or for a portion concerning a number of rooms, in relation with the installment possibilities and the hoisting equipment.

The size of the walls can be selected through the cut of the panel elements, as shown in FIG. 5. Connecting means and possibly embedding means may be provided, for example, by the use of pins 41, as shown in FIG. 22, between adjacent panels of a single monoblock wall or of concurrent walls, which are engaged in an element thickness and located in the respective seats formed after the molding of the shell elements, with a suitable bushing 42 which is set into the concrete.

Figure 26:
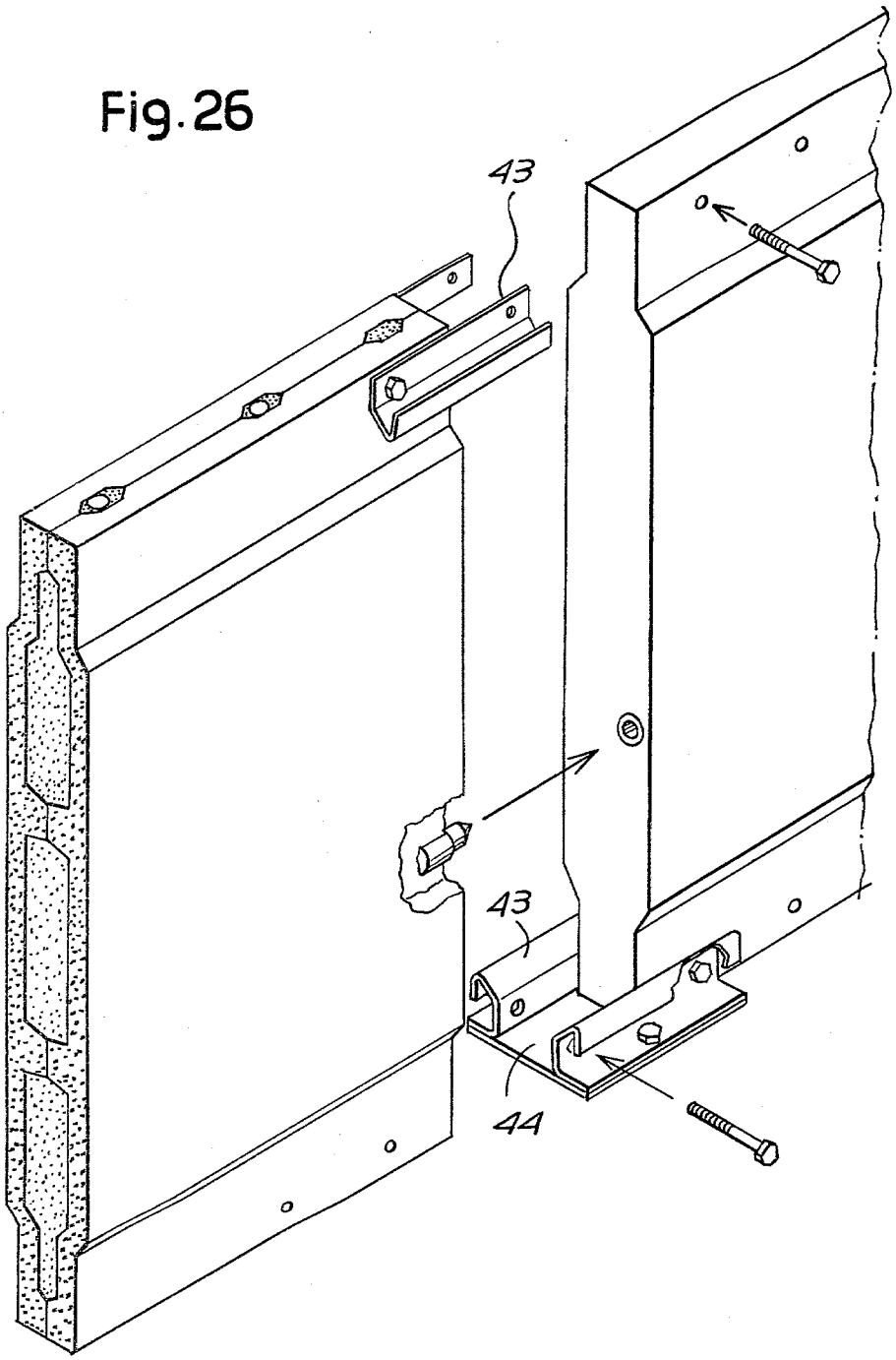
FIG. 26 is a perspective view with portions cut away showing the means for assembling the panel modules made in accordance with the invention.

Other lower and upper connecting systems between adjacent walls or adjacent and coplanar wall portions and floors can consist of special angle structural shapes 43 (See FIGS. 19, 20 and 26) which are secured through expansion screws and/or tie rods and/or equivalent means both to the horizontal floor structures S and to the elements 1. The angle pieces 43 embrace the recesses 17. These connecting means 43 can be provided and serve as joints between adjacent panel modules or in an intermediate position on one panel module. The structural shapes or sections arranged on the opposite sides of a wall unit can be connected through spacing plates 44. Sections 43 can be shaped on the upper part to allow the application of skirting boards B or frames C with a release system (See FIGS. 12 and 27).

Figure 12:
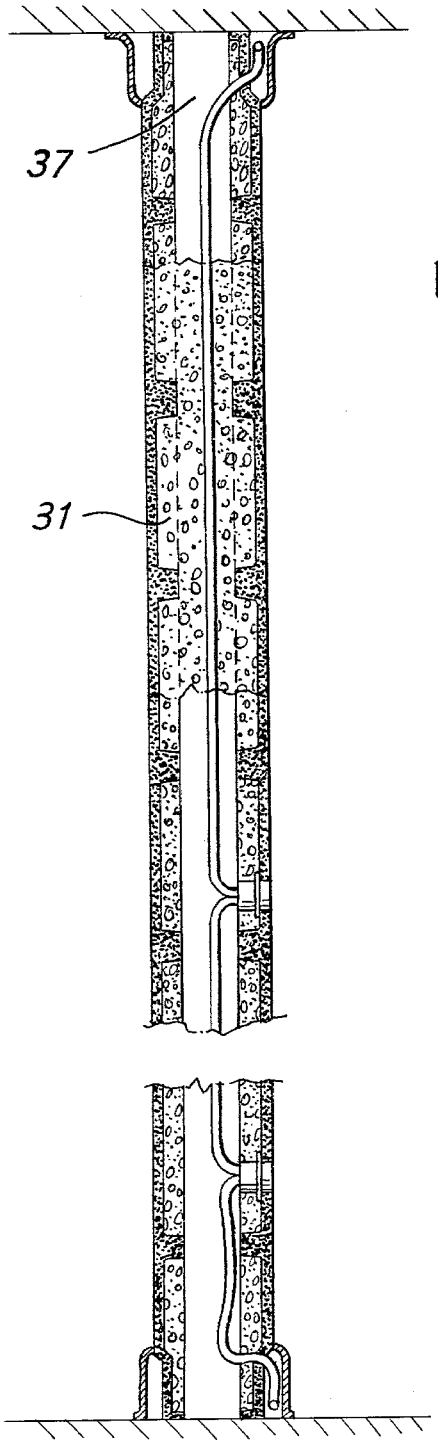
FIG. 12 is a side sectional elevational view of a wall installation, in accordance with the invention, between two horizontal structures.
Figure 13:
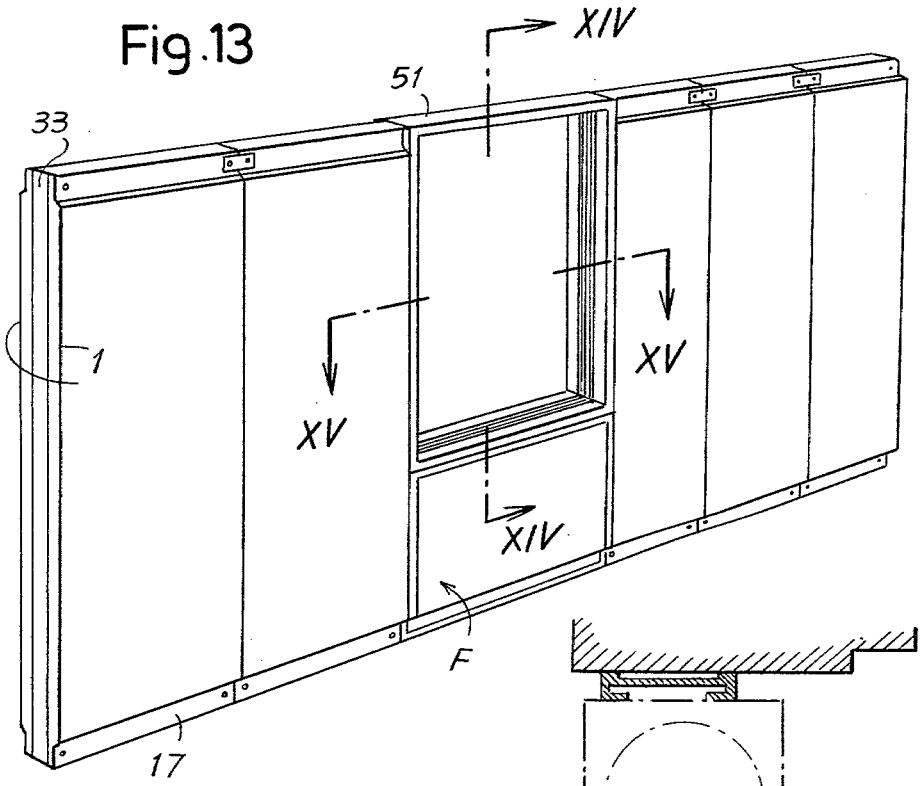
FIG. 13 is a front perspective view of a wall installation, in accordance with the invention, incorporating a window structure.
Figure 14:
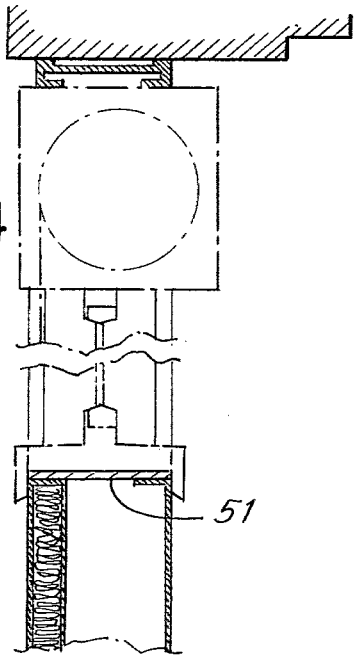
FIG. 14 is a partial view taken along the line XIV—XIV of FIG. 13.
Figure 15:
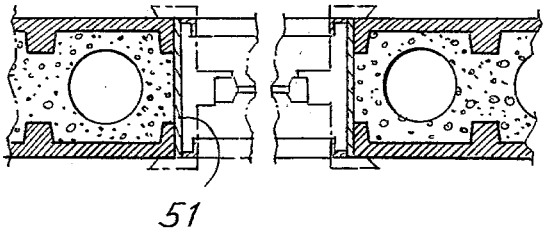
FIG. 15 is a partial view taken along lines XV—XV of FIG. 13.

Walls can be built as shown in FIGS. 12, 13 or 16, and wall portions can be provided where needed to accommodate doors and windows using special panels, such as those shown at F and P in FIGS. 13 and 16, and in better detail in FIGS. 14, 15 and 17.

These particular panels can use a counterframe, such as shown at 51 or 53, respectively, to define a window or door opening with window sill-like partial plugging structures. These can be placed beneath the sill or above the door. The frame can be built in more or less conventional ways with the optional presence of boxes and the like, of provisional crosspieces, such as shown at P in FIGS. 16 and 17, and so on.

Figure 27:
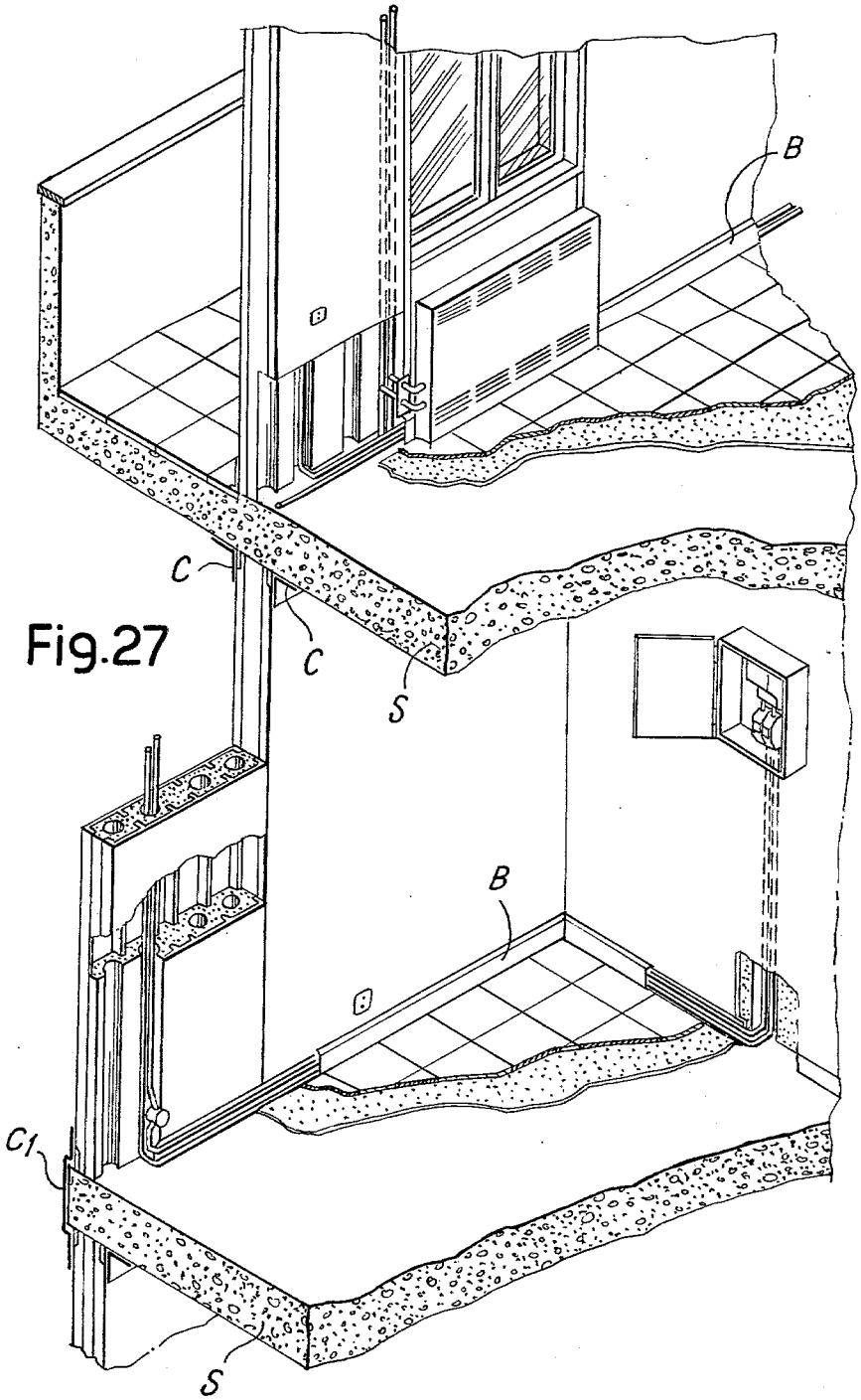
FIG. 27 is a perspective view of a building with portions cut away showing the use of wall installations constructed in accordance with the invention, their assembly and services used therewith.

The recessed steps 17 at the bases and upper ends of the wall panels formed by the pairs of elements 1 are designed for the laying of conduits of various types, either electrical or for water adduction or for heating, as shown in FIG. 27. Suitable covering sections, which may also serve as skirting-boards B on the lower part, and as a finishing frame or joint covering on the upper part, of any appropriate type, can be applied to cover the depressions or recessed steps 17 and the conduits installed herein, and to form valuable finishings between the horizontal structures and the vertical walls described above. Finishing means, such as frames $C_1$ of such an extension can be provided on the outside of the building so as to cover the depressions 17 adjacent a floor S.

The vertical conduits can contain the main pipes or risers e.g., for heating, other main risers of water, gas or the like, and drain pipes. These conduits are easily inserted gradually with the laying of walls installed as described, however, without excluding the possiblity of also embedding the conduits directly into the expanded synthetic resin during the reaction to form the same.

While specific embodiments of the invention have been shown and described in detail to illustrate the application of the principles of the invention, it will be understood that the invention may be embodied otherwise without departing from such principles.

What is claimed is:

1. A prefabricated construction for building walls, comprising: a pair of substantially flat, rectangular, cement wall elements; a plurality of integral, spaced, transverse, stiffening rib portions extending from one surface of each of said elements; a plurality of integral, spaced, longitudinal stiffening rib portions intersecting said transverse stiffening rib portions and extending from the same surface of each of said elements, at least some of said transverse rib portions on at least one of said wall elements including recesses on edges thereof away from said one surface, at least one of said recesses in one of said transverse rib portions being aligned with one of said recesses in each of a plurality of said transverse rib portions, and the depth of said recesses being less than the height of the respective transverse rear portions, said wall elements facing and spaced from each other with said stiffening rib portions of one wall element facing said stiffening rib portions of the other of said wall elements, and at least some of said stiffening rib portions of one wall element aligned with at least some of said stiffening rib portions of the other of said wall elements; and expanded synthetic material substantially filling the space between the said wall elements with at leaast one conduit passage defined in said expanded synthetic material adjacent at least some of said aligned recess of said transverse rib portions.

2. A prefabricated construction, as claimed in claim 1, further including spacer means between said pair of wall elements for defining the spacing between said wall elements.

3. A prefabricated construction, as claimed in claim 1, wherein each of said wall elements includes a plurality of spaced intermediate longitudinal stiffening rib portions of a first thickness, and one outer longitudinal stiffening rib portion on either side of said wall element of a second thickness which is thinner than said first thickness, said wall element being adapted to be divided along at least one of said intermediate longitudinal stiffening rib portions.

4. A prefabricated construction, as claimed in claim 1, wherein said wall elements are made of compressed cement.

5. A prefabricated construction, as claimed in claim 1, further including at least one indentation in said wall element adapted to be broken through to communicate with said conduit passage.

6. A prefabricated construction, as claimed in claim 1, wherein said stiffening rib portions of said one wall element are substantially opposite to but spaced from proximal edges of juxtaposed ones of said stiffening rib portions of said other wall element, and said expanded synthetic material is located in a space between said proximal edges of said stiffening rib portions.

7. A prefabricated construction, as claimed in claim 6, further including a second pair of wall elements with rib portions and expanded synthetic material substantially the same as said former mentioned pair of wall elements, said two pairs of wall elements being connected to each other in side-by-side orientation by the continuity of said expanded synthetic material extending between said two pairs of wall elements.

8. A prefabricated construction, as claimed in claim 1, wherein said transverse and said longitudinal stiffening rib portions of said one wall element abut against correspondingly oriented said stiffening rib portions of said other wall element.

9. A prefabricated construction as claimed in claim 1, further including: a second pair of wall elements with rib portions and expanded synthetic material substantially the same as said former mentioned pair of wall elements, said two pairs of wall elements being connected to each other in abutting side-by-side orientation, each of said wall elements having outermost ones of said longitudinal stiffening rib portions along the edges adjacent said elements; and connecting means for connecting said two pairs of wall elements extending through the uppermost longitudinal stiffening rib portions of said respective abutting pairs of wall elements.

10. A prefabricated construction, as claimed in claim 9, wherein said connecting means comprises a pin extending through said outermost longitudinal stiffening rib portions, said pin having a washer connected to one side thereof and a wedge extending through the other side thereof.

11. A prefabricated construction for building walls, comprising: a pair of substantially flat, rectangular, cement wall elements; a plurality of integral, spaced, transverse, stiffening rib portions extending from one surface of each of said elements; a plurality of integral, spaced, longitudinal stiffening rib portions intersecting said transverse stiffening rib portions and extending from the same surface of each of said elements, at least some of said transverse rib portions on at least one of said wall elements including recesses on edges thereof away from said one surface, at least one of said recesses in one of said transverse rib portions being aligned with one of said recesses in each of a plurality of said transverse rib portions, and the depth of said recesses being less than the height of the respective transverse rib portions, said wall elements facing and spaced from each other with said stiffening rib portions of one wall element facing said stiffening rib portions of the other of said wall elements, and at least some of said stiffening rib portions of one wall element aligned with at least some of said stiffening rib portions of the other of said wall elements; and expanded synthetic material substantially filling the space between the said wall elements with at least one conduit passage defined in said expanded synthetic material adjacent at least some of said aligned recesses of said transverse portions, at least one of said wall elements including a step portion recessed onto the opposite surface of said one wall element from said stiffening ribs integral with said wall element, said step portion extending transversely across said wall element along at least one end thereof.

12. A prefabricated construction, as claimed in claim 11, further including at least one transversely extending covering element engaged over said recessed step portion for defining a conduit passage therewith.

13. A prefabricated construction, as claimed in claim 12 further including at last one angle shaped member connected to at least one of said wall elements in said recessed step portion for supporting said covering element.

* * * * *